United States Patent [19]

Dofel

[11] Patent Number: 4,693,471

[45] Date of Patent: Sep. 15, 1987

[54] RESILIENT SUPPORT

[75] Inventor: Andrew W. R. Dofel, Castle Hill, Australia

[73] Assignee: Supafit Gymnasium Equipment Pty, Limited, Castle Hill, Australia

[21] Appl. No.: 768,519

[22] Filed: Aug. 22, 1985

[30] Foreign Application Priority Data

Aug. 22, 1984 [AU] Australia ..... PG6714

[51] Int. Cl.[4] ..... A63B 21/04; B65H 23/04

[52] U.S. Cl. ..... 272/136; 272/143; 272/126; 272/133; 226/196; 242/157 R

[58] Field of Search ..... 272/135, 136, 137, 138, 272/139, 142, 126, 131, 132, 133, 127, 125, 143, 69; 254/389; 226/196; 242/157 R; 384/280, 286, 289, 290, 291; 128/57

[56] References Cited

U.S. PATENT DOCUMENTS

| | | | |
|---|---|---|---|
| 1,882,490 | 10/1932 | Falck | 128/57 |
| 2,461,413 | 2/1949 | Dirand | 128/57 |
| 2,475,725 | 7/1949 | Shipman | 242/157 R |
| 2,619,957 | 12/1952 | Hagne | 128/57 |
| 3,356,367 | 12/1967 | Tewksbury | 272/69 |
| 3,614,098 | 10/1971 | Carr | 272/133 |
| 4,345,757 | 8/1982 | LoVoi | 128/57 |

FOREIGN PATENT DOCUMENTS

| | | | |
|---|---|---|---|
| 3306321 | 2/1983 | Fed. Rep. of Germany | 272/135 |

*Primary Examiner*—Richard J. Apley
*Assistant Examiner*—S. R. Crow
*Attorney, Agent, or Firm*—Arnold, White & Durkee

[57] ABSTRACT

A support 10 for the resistance element 11 of an exercise device, the resistance element 11 being in the form of a resilient elongated band which passes around said support 10, said support 10 having a body 12 of generally triangular configuration so as to have an apex 21 from which there diverges two support surfaces 22, said support surfaces 22 being covered by a resilient sleeve 14 against which the element 11 bears to facilitate elongation of the element 11 adjacent said support surfaces 22 resilient deformation of said sleeve 14.

11 Claims, 11 Drawing Figures

RESILIENT SUPPORT

The present invention relates to exercise devices which employ a resilient band as a resistance element in the device, and more particularly but not exclusively to the exercise device described in Australian Patent Application No. 12659/83 (USA Pat. No. 4,521,013).

In Australian Patent Application No. 12659/83 (USA Pat. No. 4,521,013), there is disclosed an exercise device which employs a strap in the form of a resilient band which provides resistance to movement of the user of the exercise device. This band passes around a roller with a tension force being applied to each extremity of the band. As a result of being tensioned, the band elongates to enable movement by the user. The roller is provided in order to enable the equalization of forces on the extremities of the band. Where the band passes around the roller, scuffing often occurs since the band elongates against the roller causing damage to the internal surface of the band contacting the roller. This damage to the band considerably shortens the life thereof.

In the above-discussed exercise device, the resilient band is provided with apertures which fit over projections mounted on a carriage. Such an arrangement has been found unsuccessful due to the friction between the projection and the aperture. In addition to this, stress concentration around the aperture considerably shortens the life of the resilient band.

It is the object of the present invention to overcome or substantially ameliorate the above disadvantage.

There is disclosed herein a support for an elongated resilient element to pass around the support, said support comprising a body having a resilient element supporting peripheral surface, and a resilient sleeve about said body and covering said peripheral surface and which contacts said element to facilitate elongation of said element adjacent said peripheral surface by resilient deformation of said sleeve, upon tensioning of said element.

A resilient band for use in an exercise device to provide the exercise device with a resistance element, said band being generally elongated and being provided at each end with a coupling assembly enabling attachment of the band to the exercise device, and wherein each coupling assembly comprises an enlarged portion of said band and a bracket embedded therein, said bracket being formed of metal and having a first portion embedded in said enlarged portion, and an attachment portion extending from within the enlarged portion, with said enlarged portion being moulded around said first portion so as to be fixed but not adhered to said first portion of said bracket.

A preferred form of the present invention will now be described by way of example with reference to the accompanying drawings wherein.

Figure 1:
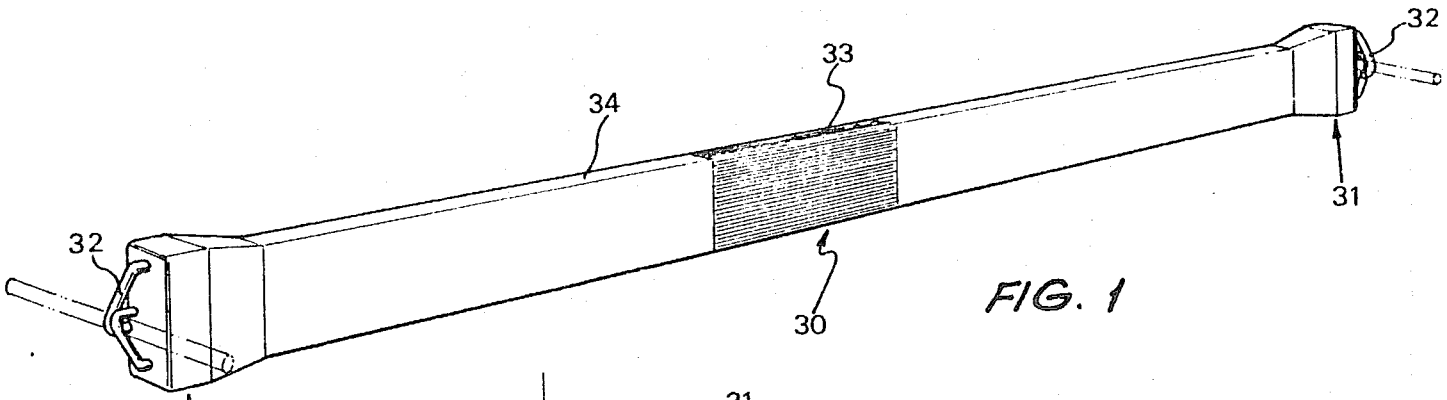
FIG. 1 is a schematic perspective view of a resilient band to be employed in an exercise device.
Figure 2:
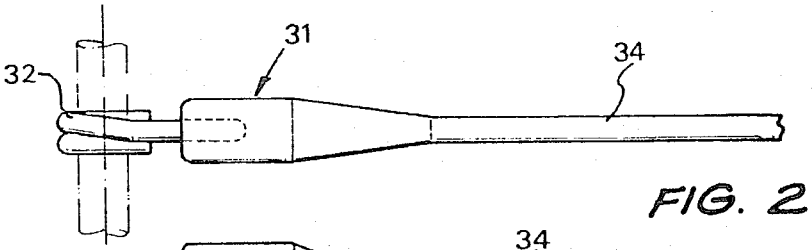
FIG. 2 is a schematic side elevation of an end portion of the band of FIG. 1.
Figure 4:
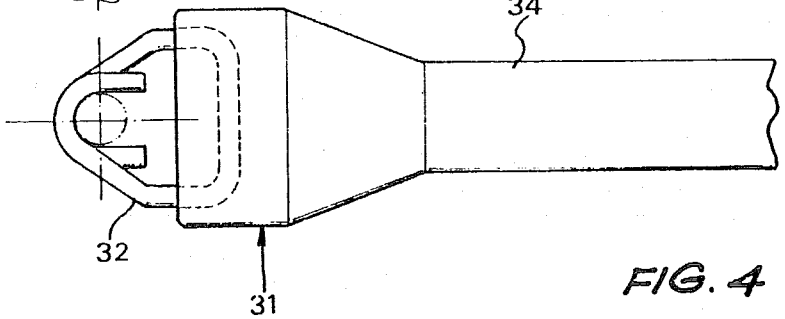
FIG. 4 is a schematic plan view of the end portion of FIG. 2.
Figure 3:
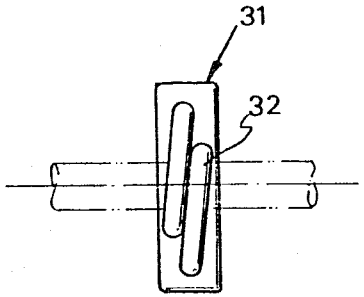
FIG. 3 is a schematic end elevation of the end portion of FIG. 2.
Figure 6:
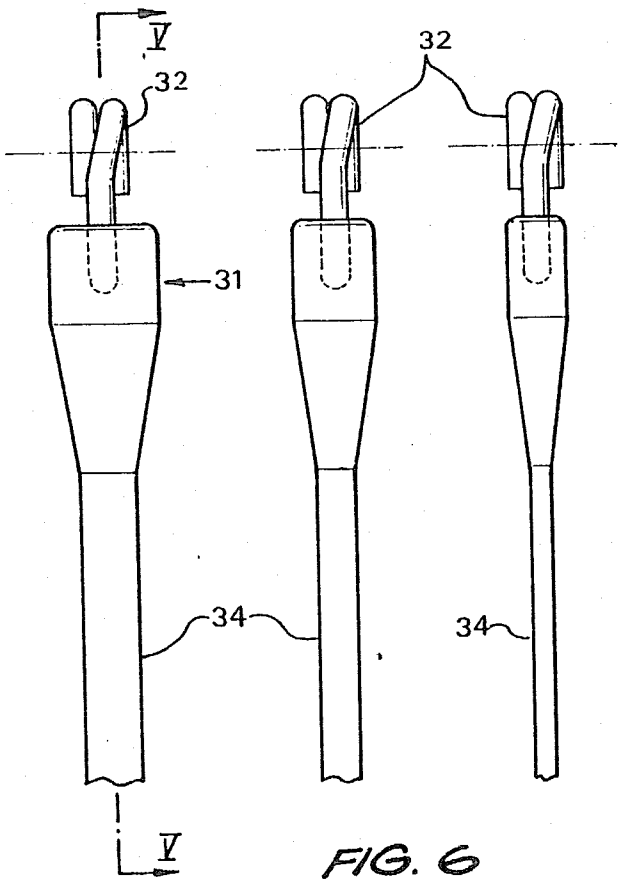
FIG. 6 is a schematic side elevation of various sizes of resistance bands similar to that of FIG. 1.
Figure 5:
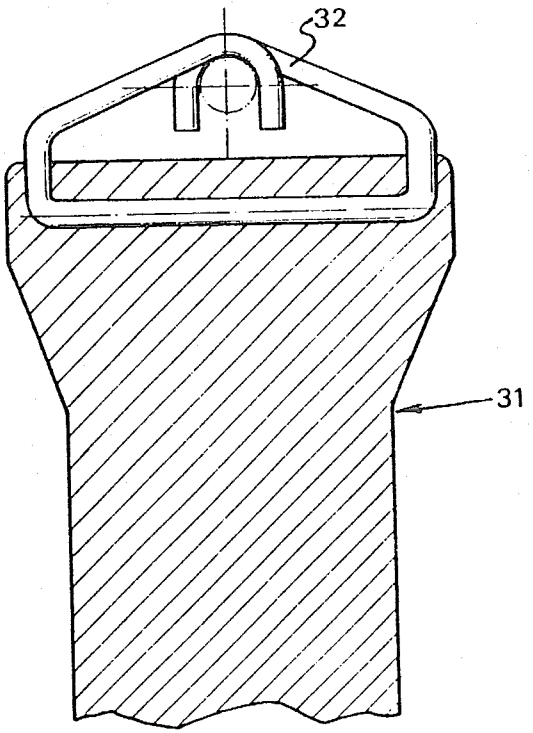
FIG. 5 is a schematic sectioned plan view of the end portion of FIG. 4.

In FIGS. 1 to 5 there is schematically depicted a resistance band 30 having an elongated body 32 provided with enlarged end portions 31. Embedded in the enlarged portions 31 are mounting brackets 32 to enable the resistance band 30 to be attached to the exercise device.

The brackets 32 are embedded in the enlarged portions 31 by the body 34 of the band being moulded thereabout. However, it should be appreciated that although the brackets 32 are embedded in the portions 31, the band material is not adhered to the brackets 32. Accordingly, under stress, the material forming the body 34 of the band 30 can move relative to the brackets 32.

Preferably, the body 34 would be formed of rubber, whether natural or synthetic. Alternatively, the body 34 may be formed of a combination of synthetic and natural rubber.

As a further modification of the resistance band 30, the central portion 33 of the body 34 may have different resilient properties to the remainder of the body 34.

Figure 7:
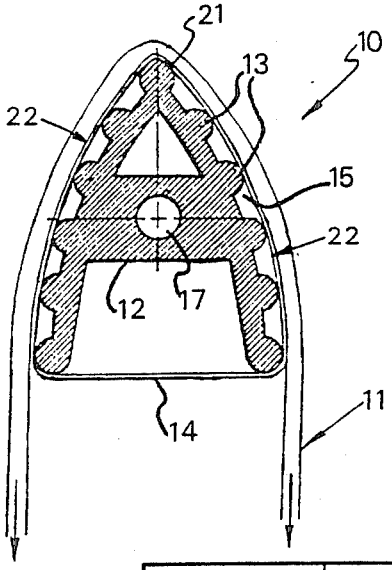
FIG. 7 is a schematic part sectioned side elevation of a support and a resilient band passing around the support.
Figure 11:
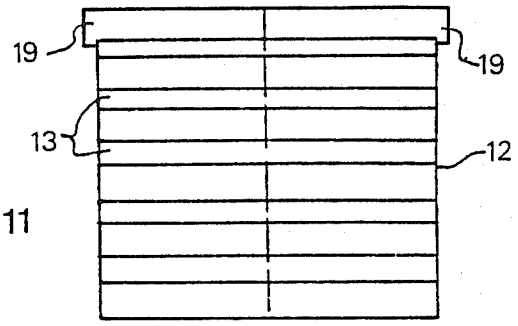
FIG. 11 is a schematic front elevation of the support of FIG. 10.
Figures 8, 9:
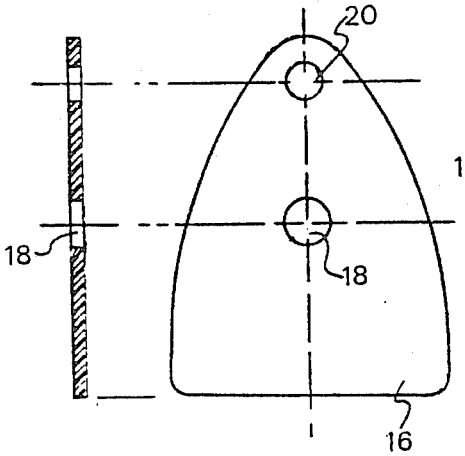
FIG. 8 is a schematic front elevation of an end plate to be used in constructing the support of FIG. 7.
FIG. 9 is a schematic side elevation of the end plate of FIG. 8.
Figure 10:
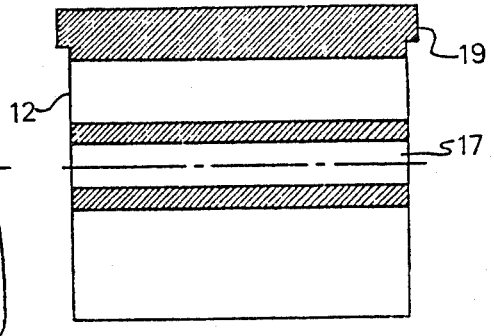
FIG. 10 is a schematic sectioned side elevation of the body employed in the support of FIG. 7.

In FIG. 7 there is schematically depicted a support 10 for a resilient band 11 of an exercise device such as the exercise device described in Australian application No. 12659/83 (USA Pat. No. 4,521,013). The band 11 may be constructed in accordance with the band 30 of FIGS. 1 to 6. The support 10 comprises a body 12 of generally triangular configuration and having an external peripheral surface provided with a plurality of ribs 13. Accordingly the body 12 has an apex 21 from which two support surfaces 22 diverge. The ribs 13 extend transversely to the band 11. Located about the peripheral surface of the body 12 is a resilient sleeve 14 which is sandwiched between the body 12 and the resilient band 11. The sleeve 14 co-operates with the ribs 13 to provide cavities 15 within which a lubrication material may be provided to lubricate the sleeve 14 to enhance relative movement between the sleeve 14 and the body 12.

In operation of the above described support 10, upon a tension force being applied to the extremities of the band 11, the band 11 is caused to extend. This extension of the band 11 about the support 10 causes a corresponding resilient deformation of the sleeve 14 so that there is no relative movement of the abutting surfaces of the band 11 and sleeve 14. This elongation of the sleeve 14 causes relative movement between the sleeve 14 and the external peripheral surface of the body 12. More particularly, the sleeve 14 moves across the ribs 13 with movement therebetween aided by means of lubrication.

Each end of the body 12 is provided with an end plate 16 which projects beyond the body 12 so as to define a track through which the band 11 passes. To enable mounting of the support 10, the body 12 is provided with a central passage 17 and each end plate 16 is provided with a passage 18. A pin then passes through the passages 17 and 18 to enable mounting of the support 10 in the exercise device. The apex of the body 12 is provided with two transversely projecting lugs 19 which engage within a recess 20 formed in each end plate 16. The lugs 19 thereby co-operate with each end plate 16 to fix the end plates 16 to the body 12.

What we claim is:

1. In combination, a support 10 and an elongated resilient exercise element 11 passing around the support 10, said support 10 comprising a generally rigid body 12 having a resilient element supporting peripheral surface; a passage 17 disposed in body 12 to secure the support 10 to a mounting means; and a resilient and moveable sleeve 14 disposed about and in moveable relation with said body 12 and covering said peripheral surface and which contacts said element 11 to facilitate elongation and movement of said element 11 adjacent said peripheral surface by resilient deformation of said sleeve 14, upon tensioning of said element 11.

2. The support 10 of claim 1 wherein said body 12 has an apex 21 from which there extends two support surfaces 22 arranged so that said element passes over said apex 21 and extends along said support surfaces 22.

3. The support 10 of claim 2 wherein said support surfaces 22 are provided with ribs 13 which in use extend transverse of said element 11.

4. The support 10 of claim 3 wherein said ribs 13 provide a plurality of cavities 15 within which a lubricant material may be provided to lubricate movement of the sleeve 14 relative to said body 12.

5. The support 10 of claim 4 wherein said body 12 is of a generally triangular configuration with said support surfaces 22 diverging from said apex 21.

6. In combination a support 10, and an elongated, resilient exercise element 11, said support comprising:

a generally rigid body 12 having an external peripheral surface adapted to support the resilient exercise element 11 along the periphery of said surface a passage 17 disposed in body 12 to secure the support 10 to a mounting means; and a resilient sleeve 14 adapted to cover the peripheral surface sandwiched between the body 12 and the exercise element 11, and to move resiliently with the exercise element 11 relative to the body 12.

7. The support of claim 6 in which the external peripheral surface of the body (12) together with the resilient sleeve (14) defines cavities therebetween capable of containing a lubrication material to lubricate the sleeve (14) and thereby enhance relative movement between the sleeve (14) and the body (12).

8. In combination a support 10 and an elongated resilient exercise element 11 passing around the support 10, said support comprising:

a generally rigid body 12 having a resilient element supporting peripheral surface a passage 17 disposed in body 12 to secure the support 10 to a mounting means;

a resilient and moveable sleeve 14 disposed about and in moveable relation with said body 12 and covering said peripheral surface and which contacts said element 11 to facilitate elongation and movement of said element 11 adjacent said peripheral surface by resilient deformation of said sleeve 14 upon tensioning of said element 11;

said body 12 together with the resilient sleeve 14 defining a series of cavities therebetween capable of containing a lubricant material to lubricate the sleeve 14 and thereby enhance relative movement between the sleeve 14 and the body 12.

9. The support 10 of claim 8 wherein the body 12 has an apex 21 from which there extends two support surfaces 22 arranged so that said element passes over said apex 21 and extends along said support surfaces 22.

10. The support 10 of claim 9 wherein said support surfaces 22 are provided with ribs 13 which in use extend traverse of said element 11.

11. The support 10 of claim 10 wherein said body is of a generally triangular configuration and with said support surfaces 22 diverging from said apex 21.

* * * * *